US010480217B2

(12) United States Patent
Gartner

(10) Patent No.: US 10,480,217 B2
(45) Date of Patent: Nov. 19, 2019

(54) UNIVERSAL LOCK WITH SLIDING BLOCKING MECHANISM

(71) Applicant: Klaus W. Gartner, Palos Verdes Estates, CA (US)

(72) Inventor: Klaus W. Gartner, Palos Verdes Estates, CA (US)

(73) Assignee: MG TECH CENTER BV H.O.D.N. LOCK TECHNOLOGY, Ulft (NL)

( * ) Notice: Subject to any disclaimer, the term of this patent is extended or adjusted under 35 U.S.C. 154(b) by 668 days.

(21) Appl. No.: 14/931,336

(22) Filed: Nov. 3, 2015

(65) Prior Publication Data

US 2016/0244995 A1 Aug. 25, 2016

Related U.S. Application Data

(63) Continuation of application No. PCT/US2015/057773, filed on Oct. 28, 2015, and a (Continued)

(51) Int. Cl.
*E05B 47/00* (2006.01)
*E05C 3/12* (2006.01)

(Continued)

(52) U.S. Cl.
CPC ..... *E05B 49/00* (2013.01); *E05B 37/00* (2013.01); *E05B 47/0012* (2013.01); *E05C 3/12* (2013.01);

(Continued)

(58) Field of Classification Search
CPC ..... Y10T 292/1021; Y10T 292/1089; Y10T 292/1028

(Continued)

(56) References Cited

U.S. PATENT DOCUMENTS 2,381,633 A * 8/1945 Young ..... E05C 3/24 292/207
3,040,555 A * 6/1962 Wartian ..... E05B 65/0811 292/106

(Continued)

FOREIGN PATENT DOCUMENTS

EP 2495379 A1 9/2012
EP 2495379 A1 9/2012

OTHER PUBLICATIONS

International Search Report and Written Opinion, issued by the ISA/U.S. Receiving Office; regarding corresponding application Serial No. PCT/US2015/017092; dated May 29, 2015; 8 pages.

(Continued)

*Primary Examiner* — Carlos Lugo
(74) *Attorney, Agent, or Firm* — Fox Rothschild LLP

(57) ABSTRACT

A lock having a housing defining a cavity with first and second opposing side walls and an opening for receiving a locking bolt, the locking bolt moveable between a locked position and an unlocked position is provided. The lock includes a rotary actuator having a rotary output and responsive to entry of an electronic combination input by a user; and a sliding blocking mechanism responsive to said rotary output and moveable between a blocking position for blocking the locking bolt in the locked position and an unblocking position for allowing the locking bolt to move into the unlocked position.

15 Claims, 14 Drawing Sheets

Related U.S. Application Data continuation-in-part of application No. PCT/US2015/017092, filed on Feb. 23, 2015.

(51) Int. Cl.
*E05B 49/00* (2006.01)
*E05B 37/00* (2006.01)

(52) U.S. Cl.
CPC .... *Y10T 292/1021* (2015.04); *Y10T 292/1028* (2015.04); *Y10T 292/1089* (2015.04)

(58) Field of Classification Search
USPC ..... 292/144, 201, 202, 207, 137, 150
See application file for complete search history.

(56) References Cited

U.S. PATENT DOCUMENTS 3,325,203 A * 6/1967 Moler ..... E05B 47/0047 292/201
3,782,139 A * 1/1974 Rubner ..... E05C 1/16 292/169
4,681,286 A 7/1987 Church et al.
4,703,960 A * 11/1987 Lense ..... E05B 47/0012 292/192
4,938,508 A * 7/1990 Thomas ..... E05C 3/047 292/106
5,142,890 A * 9/1992 Uyeda ..... E05B 47/0002 70/229
5,193,861 A * 3/1993 Juga ..... E05C 3/34 292/207
5,473,922 A * 12/1995 Bair ..... E05B 47/0012 292/144
5,862,693 A * 1/1999 Myers ..... E05B 47/0002 292/144
5,887,467 A * 3/1999 Butterweck ..... E05B 41/00 292/144
5,938,254 A * 8/1999 Weyerstall ..... E05B 81/22 292/144
6,139,073 A * 10/2000 Heffner ..... E05B 81/14 292/201
6,554,326 B1 * 4/2003 Goldman ..... E05B 47/0002 292/144
6,735,992 B2 * 5/2004 Hauer ..... E02D 29/1427 292/150
6,786,519 B2 * 9/2004 Gartner ..... E05B 17/2034 109/59 R
7,296,830 B2 * 11/2007 Koveal ..... E05B 47/0012 292/201
7,461,872 B2 12/2008 Moon
7,770,944 B2 * 8/2010 Yuan ..... E05B 47/0012 292/195
8,033,583 B2 * 10/2011 Chang ..... E05B 47/0603 292/144
8,083,273 B2 * 12/2011 Yuan ..... E05B 47/0012 292/197
8,261,586 B2 * 9/2012 Gartner ..... E05B 47/0002 292/201
8,403,376 B2 * 3/2013 Greiner ..... E05B 47/0012 292/144
8,424,934 B2 * 4/2013 Askins ..... B66B 13/185 292/199
8,727,392 B2 * 5/2014 Greiner ..... E05B 47/0012 292/144
8,826,709 B2 * 9/2014 Dehaven ..... E05B 17/0062 70/333 R
2003/0094820 A1 * 5/2003 Erices ..... E05B 81/22 292/341.16
2005/0110279 A1 * 5/2005 Kalsi ..... E05B 81/06 292/144
2007/0252394 A1 11/2007 Moon et al.
2008/0073916 A1 * 3/2008 Min ..... E05B 47/0603 292/201
2008/0169657 A1 * 7/2008 Horton ..... E05B 83/30 292/220
2008/0276672 A1 11/2008 Gartner
2008/0314100 A1 * 12/2008 Min ..... E05B 47/0012 70/278.1
2013/0127181 A1 * 5/2013 Rocchitelli ..... D06F 37/28 292/182

OTHER PUBLICATIONS

International Search Report and Written Opinion, issued by the ISA/U.S. Receiving Office, regarding corresponding patent application Serial No. PCT/US2015/057773; dated May 6, 2016; 11 pages.
Extended European Search Report, issued by the European Patent Office, regarding corresponding patent application Serial No. EP 15883625.4, dated Oct. 25, 2018, 7 pages.
Extended European Search Report, issued by the European Patent Office, regarding corresponding patent application Serial No. EP 15883531.4, dated Oct. 25, 2018, 6 pages.

* cited by examiner

UNIVERSAL LOCK WITH SLIDING BLOCKING MECHANISM

CROSS REFERENCE TO RELATED APPLICATIONS

This application is a continuation of International patent application Serial No.: PCT/US2015/057773, filed on Oct. 28, 2015; and a continuation-in-part of International patent application Serial No.: PCT/US2015/017092, filed on Feb. 23, 2015; the entireties of which are hereby incorporated by reference.

FIELD OF THE INVENTION

The present invention relates generally to an electronic lock having a sliding blocking mechanism that prevents a bolt from moving to an unlocked condition.

BACKGROUND OF THE INVENTION

Doors of safes, vaults, strong rooms, container and similar security closures (collectively called "safes" in this application) usually have at least one and preferably several safe bolts that reciprocate from a non-locking position to an extended locking position. In the locking position, the safe bolts extend from the safe door into the adjacent safe walls. When the safe has more than one bolt, bolt works connect the bolts. The bolt works include linkages that move the safe bolts simultaneously when a user turns a handle. A locking device cooperates with the bolt works to secure the safe bolts in their extended locking position.

Swing bolt or rotary bolt locking devices mount a bolt for pivoting between locked and unlocked positions. This application refers to the swing bolt within the locking device as the "bolt," "swing bolt," or "locking bolt." The bolts that secure the safe door to the rest of the safe are called "safe bolts." In the locked position, part of the locking bolt projects out of the housing and interferes with a portion of the mechanical bolt works, thereby preventing the bolt works from moving the safe bolts to the unlocked position. When the user enters the correct combination, the lock mechanism allows the locking bolt to pivot to the unlocked position within the housing, thus allowing the user to open the safe door.

Rectilinear bolt locking devices operate in a similar manner. In particular, rectilinear bolt locking devices mount a bolt within a housing for moving between locked and unlocked positions. Thus, instead of pivoting like rotary bolts, linear bolts slide into and out of the locking device housing. When the user enters the correct combination, the lock mechanism allows the locking bolt to slide into the housing. For purposes of explanation and example, the remainder of the background discussion will focus on rotary type locking devices.

In general, a handle on the outside of the safe connects to the bolt works. Rotating the handle initiates movement of the bolt works. If the user enters the correct combination which unlocks or releases the locking bolt, the bolt works can pivot the rotary bolt so that the rotary bolt does not project from the housing. This unlocked position permits the bolt works to continue moving the safe bolts to the unlocked condition, allowing the operator to open the safe. If, however, the rotary bolt is locked, the rotary bolt blocks movement of the bolt works, preventing the bolt works from withdrawing the safe bolts.

The locking mechanism within the lock housing blocks the bolt from pivoting to the unlocked position. U.S. Pat. Nos. 5,134,870 and 5,142,890 to Uydeda utilizes a linear solenoid within the housing. Uyeda discloses a solenoid plunger that directly engages the locking bolt. Alternatively, the solenoid plunger engages a locking plate that projects against the bolt. When the plunger or plate engages the bolt, the bolt normally cannot rotate to an unlocked position.

An electronic combination entry system controls the solenoid. Typically, the user enters the combination through a digital input pad. Internal circuitry senses entry of the correct combination and sends an electrical signal to the solenoid. The signal causes the solenoid to withdraw a plunger, which, in turn, allows the locking plate to disengage the locking bolt. The user rotates a handle which in turn manipulates the bolt works. Part of the bolt works pushes on the locking bolt to rotate the bolt about a shaft to the unlocked position. The bolt works then withdraws the safe bolts.

One design of a lock assembly is disclosed in U.S. Pat. No. 6,786,519 to Gartner. Gartner discloses a solenoid mounted within a housing and a plunger on the solenoid that engages a locking plate. When the lock is in the locked condition, the locking plate engages the locking bolt, preventing the swing bolt from pivoting. When a user enters the correct combination, the plunger disengages the locking plate so that the latter is free to slide out of its engagement with the locking bolt.

Unfortunately, mechanisms such as the one disclosed in '519 to Gartner provide insufficient protection against unauthorized access into the safe. Solutions such as those disclosed by Gartner and Uyeda that utilize linear solenoids to control movement of a plunger into and out of a locking bolt or a locking plate provide insufficient protection against unauthorized entry into a safe. In the locked position, the plunger connected to the linear solenoid is extended such that it engages with, for example, a rotary locking bolt. In the unlocked position, the plunger retracts such that it no longer engages with the locking plate, thereby allowing the locking bolt to freely rotate. A problem arises when the linear solenoid, an electromagnetic device, receives a "shock." Shock can be a result of physical tampering, applied force, vibration, etc. Typically, when a linear solenoid receives a shock, it causes an extended shaft (or in this case, the plunger) to retract in reaction to the shock. This poses a problem because the retraction of the plunger without entering the correct combination would effectively allow unauthorized access into the safe despite the addition of a notch and safety key feature.

Accordingly, there is a need for a lock having a blocking device that is simple to assemble, cost efficient, and that can reliably block access under force and shock.

BRIEF SUMMARY OF THE INVENTION

The problems outlined above are addressed by the universal lock having a sliding stop mechanism in accordance with the invention. The present invention solves the foregoing problems by providing a lock including a housing having an opening for a locking bolt, a locking bolt movable between a locked position and an unlocked position, an actuator positioned within the housing and a sliding stop mechanism received in the housing.

In one aspect of the invention, the sliding stop mechanism includes a substantially C-shaped in cross section rotatable member, which is received in a substantially U-shaped in cross-section slider. The rotatable member comprises a cam that translates the rotary movement of the actuator into linear movement of the substantially U-shaped in cross section slider. The rotatable member is received on a surface or within a channel of the blocking member. The rotatable member is configured to rotate between a first position corresponding to the locked position of the locking bolt and a second position corresponding to the unlocked position of the locking bolt. Correspondingly, the U-shaped in cross-section blocking device is responsive to the rotation of the cam and moves linearly between a first position in which the locking bolt is in a locked position and a second position which allows the locking bolt to by-pass the blocking member to the unlocked position.

In another aspect of the invention, a lock including a housing defining a cavity with first and second opposing side walls and an opening for receiving a locking bolt moveable between a locked position and an unlocked position is provided. The lock includes a rotary actuator having a rotary output and responsive to entry of an electronic combination input by a user; and a sliding blocking mechanism responsive to said rotary output and moveable between a blocking position for blocking said locking bolt in the locked position and an unblocking position for allowing said locking bolt to move into said unlocked position, the sliding blocking mechanism including a rotatable member comprising a cam having a camming surface and a substantially U-shaped in cross-section slider having a channel or bottom surface for engaging said camming surface and a blocking arm for blocking engagement with said rotary bolt, wherein actuation of the rotary actuator causes the rotatable cam to rotate in said channel or on a bottom surface to cause linear movement of said U-shaped slider to an unblocking position allowing said locking bolt to move into said unlocked position.

In a further aspect of the lock in accordance with the invention, the lock includes a housing having an opening for receiving a locking bolt movable between a locked position and an unlocked position; a rotary actuator positioned within the housing and energizable between a locked condition for maintaining the locking bolt in the locked position and an unlocked condition that allows the locking bolt to move to the unlocked position; and a sliding blocking mechanism received in said housing, said sliding blocking mechanism including a rotatable member having a camming surface and a substantially U-shaped in cross section slider having a channel for engaging said camming surface and a first arm having a blocking portion, the rotatable member operably coupled to the rotary actuator, said sliding blocking mechanism normally biased in a blocking position in which the first arm blocking portion is configured to engage and block the locking bolt from being moved to the unlocked position, wherein upon actuation, the rotary actuator causes the rotatable member to rotate by a predetermined amount in said channel and cause said U-shaped slider to move linearly to an unblocking position allowing the locking bolt to move into the unlocked position. The rotatable member also includes a stop portion operably coupled thereto for preventing the rotatable member from further rotation. The stop portion engages a wall in the cavity of the housing which prevents further rotational movement of the rotatable member and correspondingly further linear movement of the U-shaped slider.

A dial operably coupled to the lock includes a key pad having a series of electronic numbers, typically from 1-9 and 0 which, when contacted by a user entering the correct combination, will generate an electronic signal to rotary means. The rotary means, which may be a solenoid, is coupled to the rotatable member. In one aspect of the invention the rotatable member is a cam. Upon receiving the electronic signal the solenoid causes the rotatable member to rotate by a predetermined amount. A camming surface of the rotatable member is received in a channel in the blocking member such that as the camming surface rotates in the channel it causes the blocking member to move linearly to an unlocked position that enables the locking bolt to by-pass the blocking member allowing the authorized user to open the lock.

In another aspect of the invention, the sliding blocking mechanism includes a substantially D-shaped in cross section rotatable member, which is received in a substantially rectangular or box-shaped in cross-section sliding blocking member. The D-shaped rotatable member includes a flat surface and a round surface. A compression spring is received in an opening in the sliding blocking member and biases the blocking member in the blocking position, which prevents the locking bolt from retracting into the housing. The sliding blocking member includes an inner portion having a bottom surface that includes a lower surface, a ramp section and an elevated portion that is higher than the lower surface. The D-shaped rotatable member is operably coupled and responsive to the rotary output of a rotary actuator. In the blocking position, the D-shaped rotatable member is positioned in a first portion of the substantially rectangular or box-shaped in cross-section sliding blocking member. In this position, the ramp and elevated portion of the blocking member cannot bypass the rounded portion of the D-shaped member, i.e. if an unauthorized user applies force to the locking bolt. When actuated, the D-shaped member rotates such that the flat portion is substantially parallel to the bottom surface of the sliding blocking member and allows the ramp and elevated portion to by-pass the D-shaped member.

The D-shaped rotatable member is configured to rotate between a first position corresponding to the locked position of the locking bolt and a second position corresponding to the unlocked position of the locking bolt.

In another aspect of the invention, the substantially rectangular or box-shaped in cross-section sliding blocking member has a side edge that is chamfered and engages the tip portion of a rotary locking bolt in the locked position.

When a user enters the correct combination, the rotary actuator causes the D-shaped member to rotate to the unblocking position. Manual force applied by the user in turning the handle of the lock causes the tip portion of the locking bolt to push against the chamfered edge causing the substantially rectangular or square-shaped in cross-section slider to move toward the unblocking position allowing the lock to be opened. When the locking bolt returns to the locked position, a spring exerts force against the blocking member causing it to return to the blocking position.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE INVENTION

Figure 1:
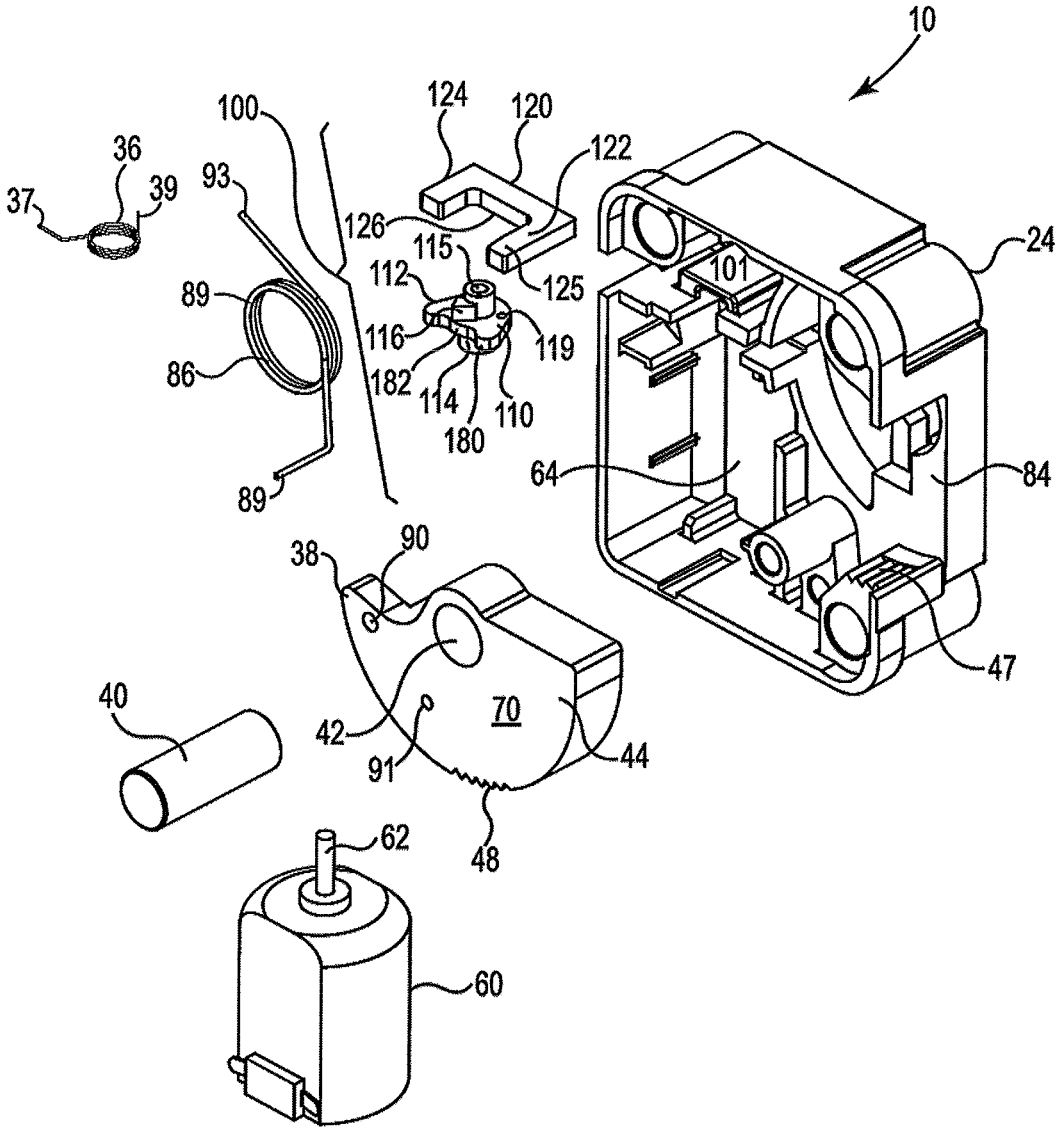
FIG. 1 is an exploded view of the lock having a substantially U-shaped sliding blocking member showing the housing.

Referring to FIG. 1 an exploded view of the lock 10 in accordance with the invention is shown. Lock 10 broadly includes housing 24, locking bolt 70, actuator 60, and sliding blocking mechanism 100.

Figure 2:
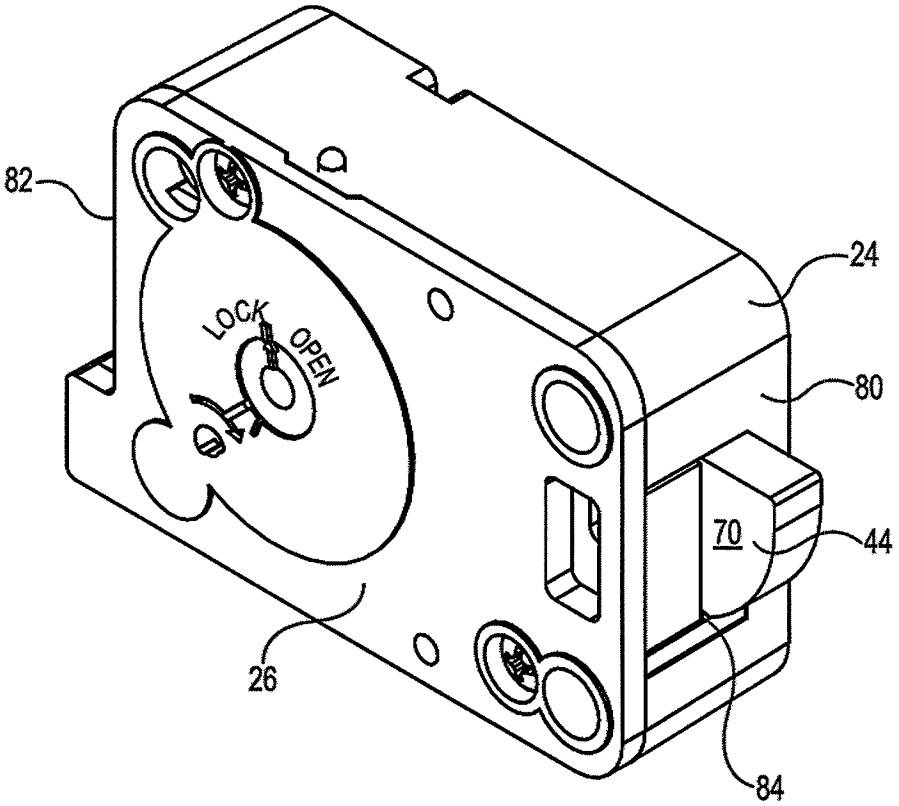
FIG. 2 is an exemplary housing in which the lock is housed showing the face plate and the side walls.

Housing 24 of lock 10 includes faceplate 26 and first and second opposing side walls 80, 82 including opening 84 for receiving a locking bolt 70 as best seen in FIG. 2. The universal lock is mounted to a wall (not shown) which is representative of the door of a container, a safe or security room, or portions of a wall adjacent to such doors. A dial is mounted on a forward side of the wall. The dial is capable of accepting an electronic entry combination or a manual entry combination.

Figure 3:
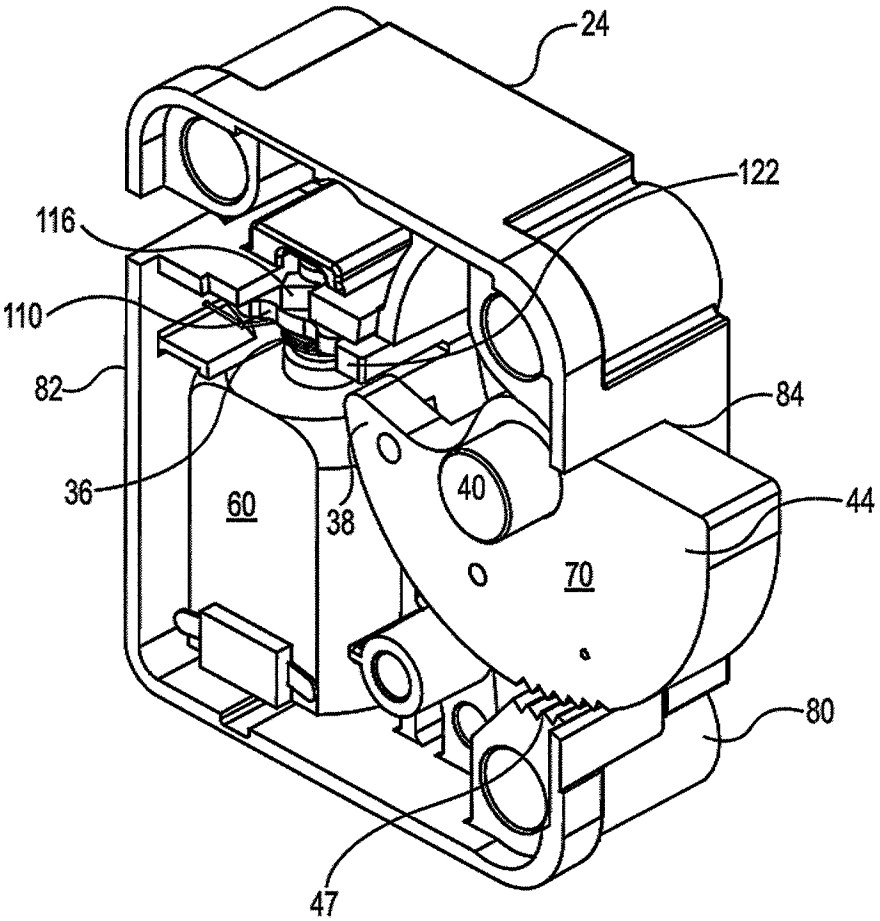
FIG. 3 is a perspective view of the lock having a U-shaped blocking member in accordance with the invention.

Referring now to FIGS. 1 and 3, a locking bolt 70 mounts in housing 24. In the present embodiment, locking bolt 70 is a rotary bolt having a generally D-shape in cross-section. However, it should be understood that various other shapes of locking bolt 70 are contemplated and within the intended scope of the present invention. A shaft receiving opening 42 is positioned near the center of rotary bolt 70. Shaft receiving opening 42 is configured to receive a shaft or axle 40 that mounts within the housing 24. Shaft 40 mounts in first and second sleeves (not shown) located on the inside walls of housing 24. Shaft receiving opening 42 is generally round and has a diameter that is slightly larger than the diameter of shaft 43. Shaft receiving opening 42 of locking bolt 40 fits onto shaft 40, allowing locking bolt 70 to rotate about the shaft. Thus, a bearing means is formed between opening 42 of locking bolt 70 and shaft 40, which remains generally stationary as locking bolt 70 rotates.

Figure 8:
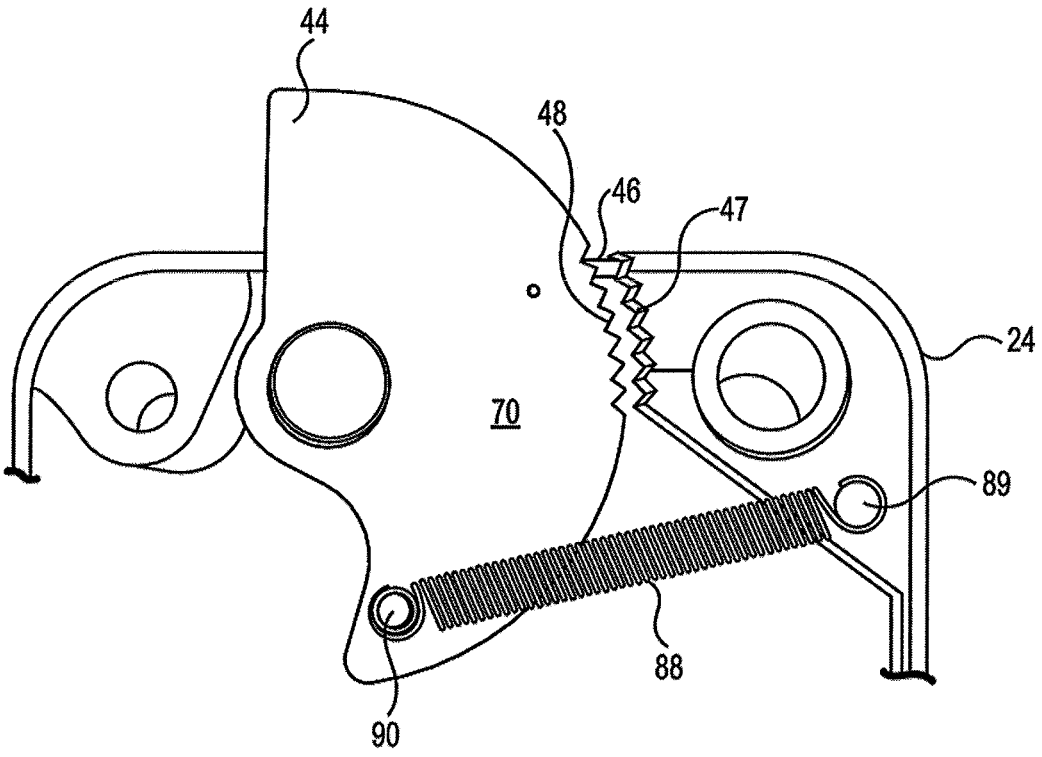
FIG. 8 is a top view showing an alternative means for biasing the locking bolt in the locked position.

As seen in FIG. 1, the center portion 87 of helical torsion spring 86 is positioned on shaft 40 between the bolt and the housing. First arm 89 is received in locking bolt aperture 91. Second arm 93 is received under a shelf or ledge (not shown) in housing 24. This configuration of helical torsion spring 86 biases the locking bolt 70 in the locked position. Alternatively, as seen in FIG. 8, a compression spring 88 stretches from a pin 89 that is located on the inside wall of housing 24 to another pin (not shown) in housing 24 that is received in aperture 90 positioned through locking bolt 70.

In each case, tension from the springs 86, 88 biases locking bolt 70 counterclockwise with extended portion 44 of bolt 70 in the locked position extended outside the housing 24.

Figure 4:
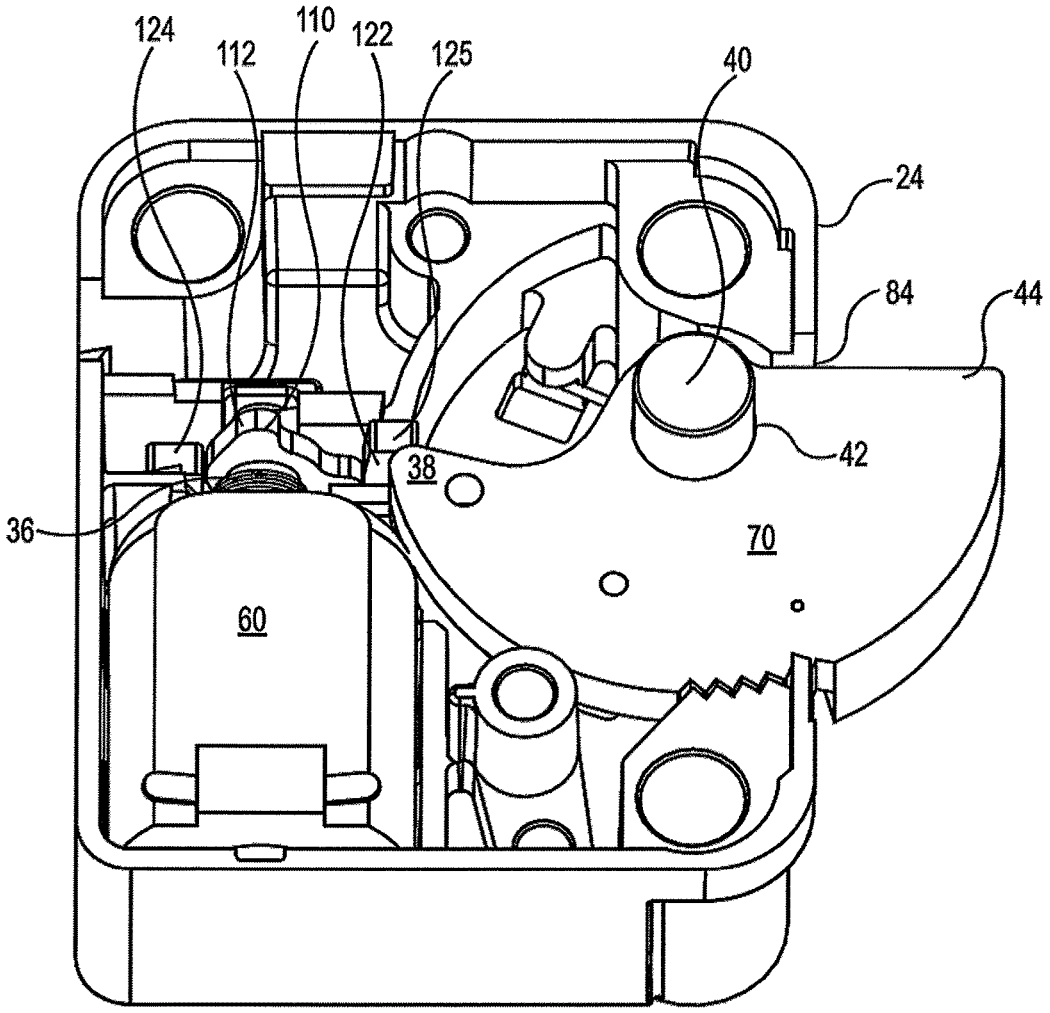
FIG. 4 is a top view of the lock having a U-shaped blocking member showing the lock in the locked position.
Figure 5:
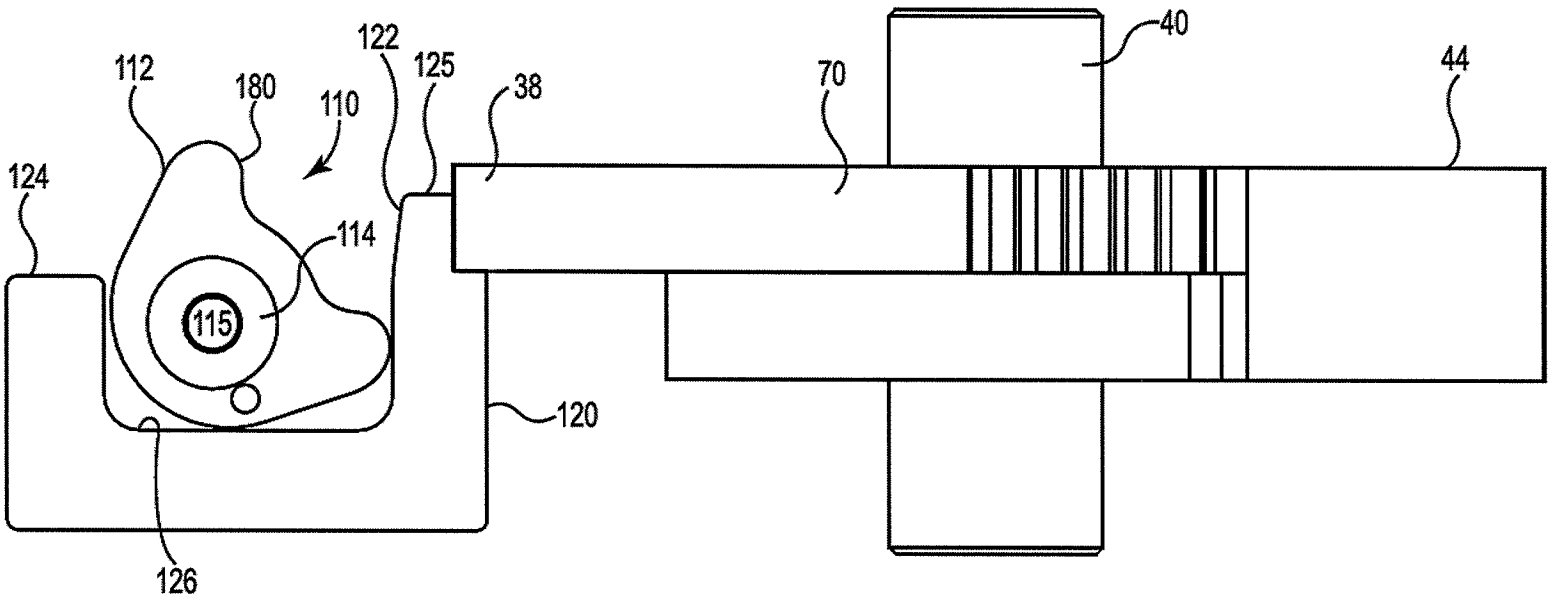
FIG. 5 is a cut away illustration showing the U-shaped blocking member blocking the locking bolt from moving to the unlocked position.
Figure 6:
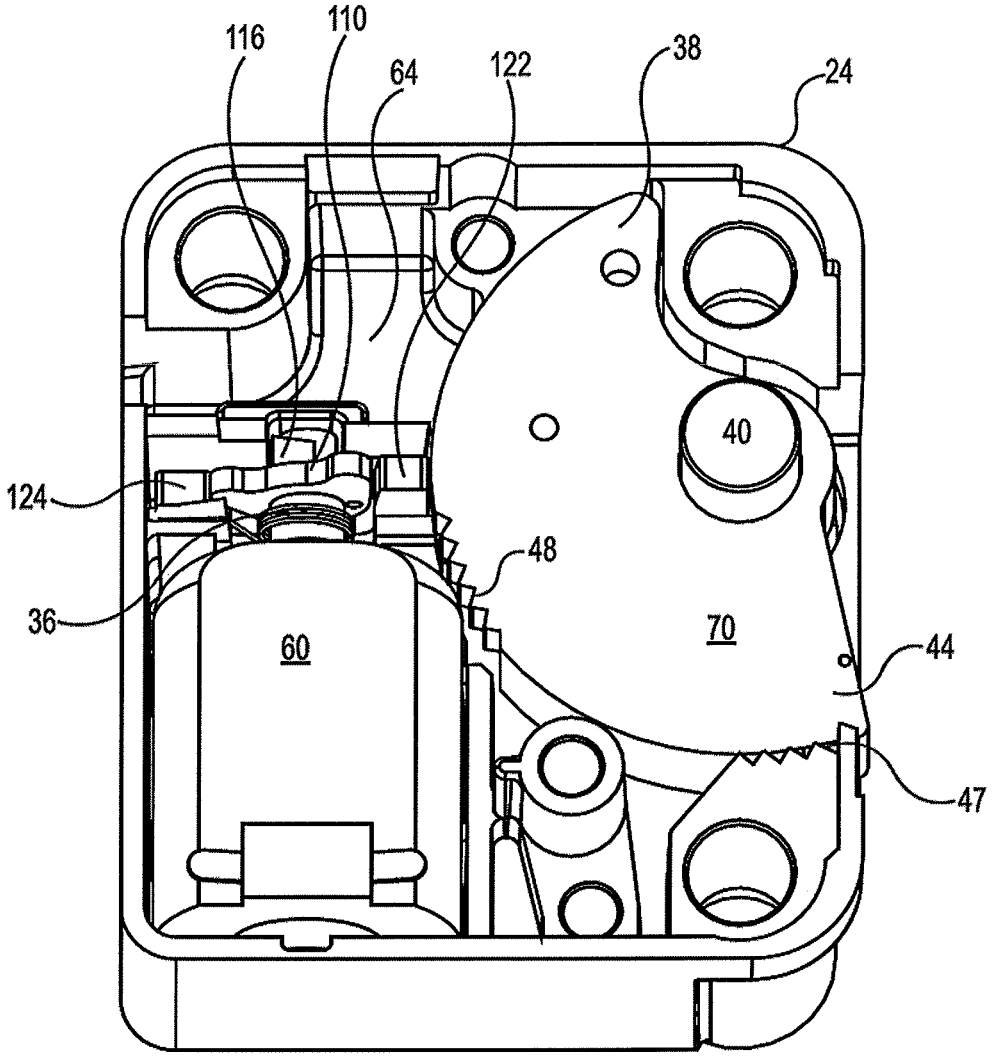
FIG. 6 is a top view of the lock having a U-shaped blocking member showing the locking bolt in the unlocked position.
Figure 7:
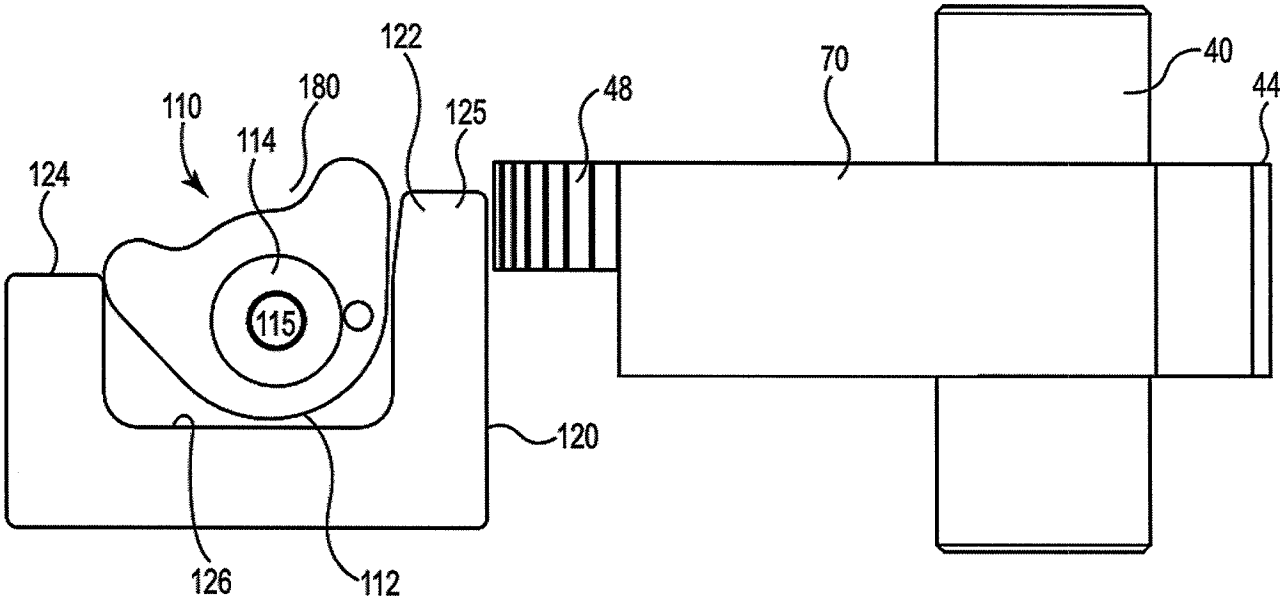
FIG. 7 is a cut away illustration showing the U-shaped blocking member in the unblocking position allowing the locking bolt to move to the unlocked position.

Locking bolt 70 is illustrated in FIGS. 3, 4 and 5 in the locked position. In the locked position, extended portion 44 of locking bolt 70 extends outside locking bolt opening 84. Locking bolt opening 84 is an opening or slot in the wall of housing 24 that is typically formed when the housing is cast. In operation, locking bolt 70 rotates to an unlocked position in which extended portion 44 of locking bolt 70 retracts within housing 24. The movement of locking bolt 70 between the locked and unlocked positions will be described in more detail hereinafter.

Figure 10:
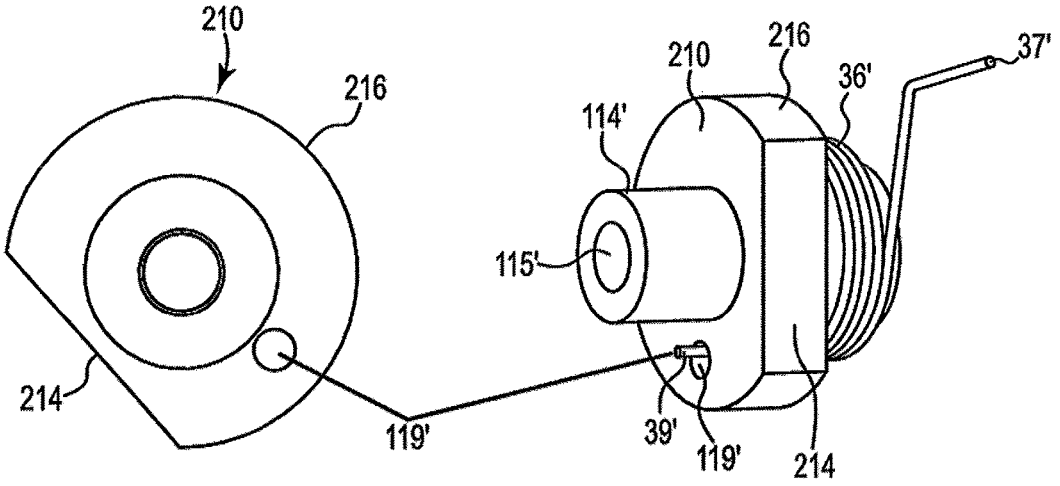
FIG. 10 is a detailed view of the D-shaped rotatable member with helical torsion spring.
Figure 11:
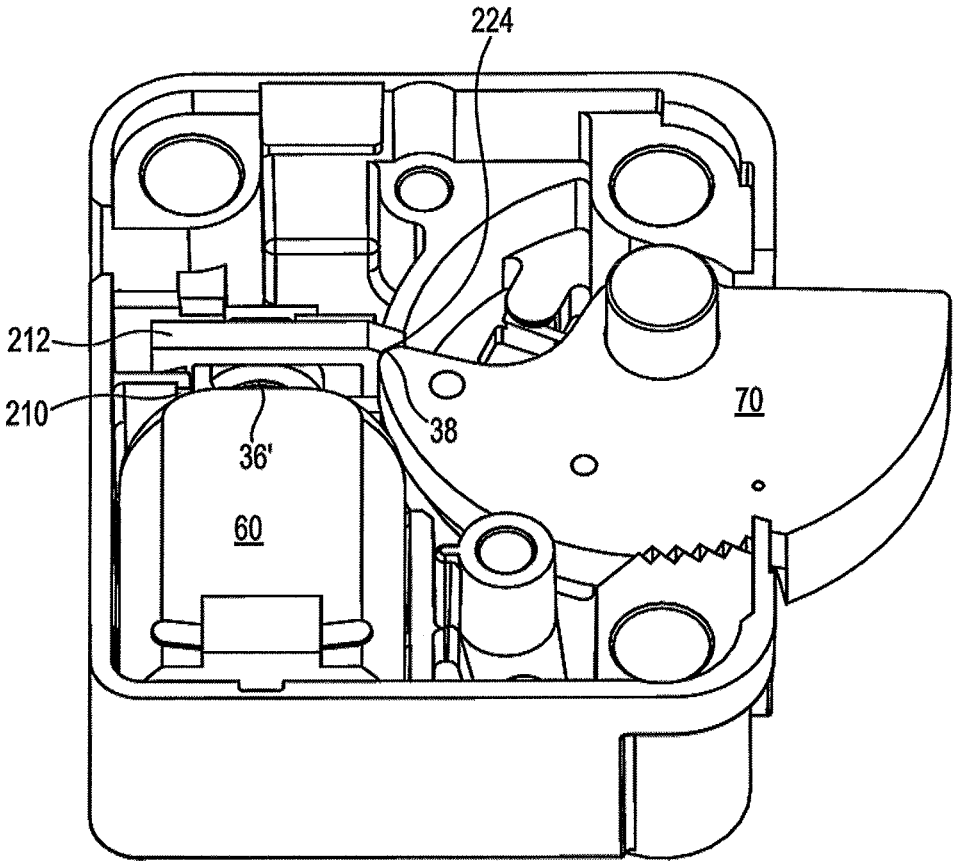
FIG. 11 is a top perspective view of the lock having a rectangular blocking member in accordance with the invention showing the blocking member in the blocking position and the lock in the locked position.

Actuator 60 mounts inside housing 24. Many different types of actuators may be used including, but not limited to, motors, rotary solenoids, electronic and mechanical rotary devices, and electromagnetic rotary devices. For purposes of example, actuator 60 will be described as a rotary solenoid throughout the remainder of this disclosure. Rotary solenoid 60 mounts in a cavity 64 within housing 24, which is formed by several walls extending upward from the inside wall of housing 24, as best seen in FIG. 1. The walls forming cavity 64 are typically part of the casting that forms housing 24. Rotary solenoid 60 includes rotary shaft 62 that is rotatably coupled to receiving shaft 114 of rotatable member 110 as hereinafter described. As best seen in FIG. 10, a second helical torsion spring 36 is received by shaft 114, 114'. First arm 37, 37' is positioned against a sidewall in housing 24 while second arm 39, 39' is received by aperture 119, 119' and acts to bias rotatable member 110 and cam member 210 in the blocking position as best seen in FIGS. 4 and 11.

Referring again to FIGS. 1-8, sliding blocking mechanism 100 broadly includes rotatable member 110 having camming surface 112, shaft 114 including shaft receiving lumen 115, stop 116 operably coupled to a surface of the rotatable member and U-shaped in cross-section sliding blocking member 120. Rotatable member 110 is substantially C-shaped in cross section and is rotatably received by rotary shaft 62 into shaft receiving lumen 115. C-shaped in cross section rotatable member 110 includes a rounded camming surface 112 and a substantially concave portion 190. U-shaped in cross section sliding blocking member includes first arm 122 and second arm 124. First arm 122 has a length that is greater than the length of second arm 124 to create a blocking portion 125 that acts to block the tip 36 of locking bolt and thus locking bolt 70 from retracting into housing 24. Arms 122, 124 form channel 126 therebetween which operably receives rotatable member 110. Those of skill in the art will appreciate that channel 126 may also comprise a flat surface upon which the camming surface 112 rests rather than a trough in which the camming surface is received. Camming surface 112 of rotatable member 110 rotatably rests on channel 126 formed on the inner surface of U-shaped sliding blocking member. The rotatable member 110 translates the rotary movement of the actuator into linear movement of the substantially U-shaped in cross section sliding blocking member 120.

Stop 116 is coupled to a surface of rotatable member 110. Stop 116 is depicted as being triangular in shape but those of skill in the art will appreciate that stop 116 may be any shape such as rectangular, cylindrical, square, etc. so long as it functions to prevent further movement of the rotatable member 110. When rotatable member 110 receives rotary output from actuator 60, stop 116 prevents rotatable member 110 from further rotation. Stop 116 is received in a pocket 101 in housing and engages the side walls of the pocket as rotatable member 110 moves from the blocking position to the unblocking position and back to the blocking and correspondingly limits further linear movement of the U-shaped sliding blocking member.

In operation, a user enters the correct combination on electronic key pad on a dial pad located outside the safe or other container door. Electronic circuitry signals solenoid 60 to rotate rotatable member by a predetermined amount. As a result, the rotatable member 110, which is responsive to the rotary output of solenoid 60 rotates as the camming surface 112 engages the surface of channel 126 of U-shaped sliding blocking member 120. As the camming surface 112 continues to move in channel 126 it disengages from first arm 122 and commences to rotatably engage second arm 124 which causes U-shaped slider 120 to move linearly. As U-shaped slider 120 moves linearly first arm 122 disengages tip 38 of locking bolt 70. After rotating by the predetermined amount of rotary output, stop 116 of rotatable member 110 prevents further movement of rotatable member 110 by contacting an inner wall of cavity 64 in housing 24 as best seen in FIG. 4.

A user then turns the handle on the safe door (or other container being secured) which retracts the locking bolt 44 into housing 24 to permit access to the inside of the safe. The user then turns the handle on the safe door to move the locking bolt back into the locked position. Rotational torsion spring 26 which biases the sliding blocking mechanism 100 in the locked position, as hereinbefore described, causes U-shaped sliding blocking mechanism to move back to the blocking position.

As may also be seen in FIG. 8 the locking bolt may include an optional tamper resistant mechanism comprising a plurality of teeth 45 in the locking bolt 70 and a plurality of corresponding teeth 47 in the housing 24. Attempting to forcibly rotate the locking bolt 70 from the locked position, as best seen in FIG. 10, to the unlocked position while the actuator is in the locked condition causes the plurality of teeth on the locking bolt to engage with the teeth 47 in the housing 24 preventing unauthorized entry.

A second aspect of the invention is depicted in FIGS. 9-14 as will hereinafter be described. Like elements are labeled with like reference numerals.

Figure 9:
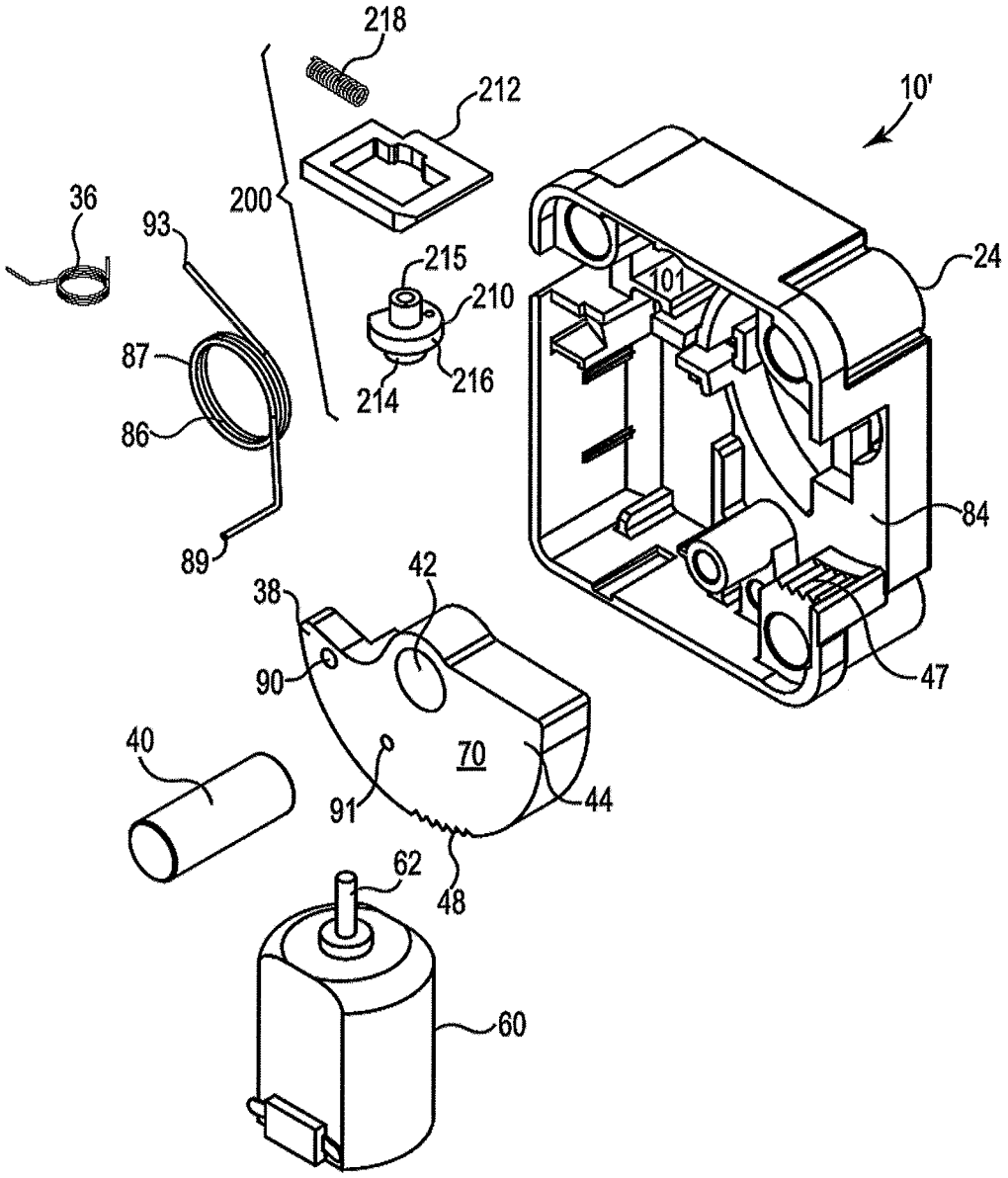
FIG. 9 is an exploded view of the lock having a rectangular or box-shaped blocking member showing the housing.

Referring now to FIG. 9 sliding blocking mechanism 210 includes a substantially D-shaped in cross section rotatable member 210, which is received in a substantially rectangular or box-shaped in cross-section sliding blocking member 212. D-shaped in cross section rotatable member 210 does not transform rotary movement of the actuator 60 into linear movement of sliding blocking member 212. Rather, D-shaped rotatable member 210 is responsive to the rotary output of solenoid 60 and rotates to allow sliding blocking member 212 to by-pass the D-shaped rotatable member 210 upon exertion of force by locking bolt 70 against chamfered edge 224.

The D-shaped rotatable member includes a flat surface 214 and a round surface 216. A compression spring 218 is received in an opening 220 in the side of the box-shaped sliding blocking member. A first end of the spring 222 abuts a sidewall in housing 24 and biases the sliding blocking member 212 in the blocking position by exerting a force thereon, which prevents the locking bolt from retracting into the housing as hereinafter described. The substantially rectangular or box-shaped in cross-section sliding blocking member 212 includes a side edge 224 that is chamfered and engages the tip portion 38 of locking bolt 70. Due to the force exerted on blocking member 212 by compression spring 218 the tip 38 of locking bolt 70 is prevented from passing to the unlocked position.

Figure 12:
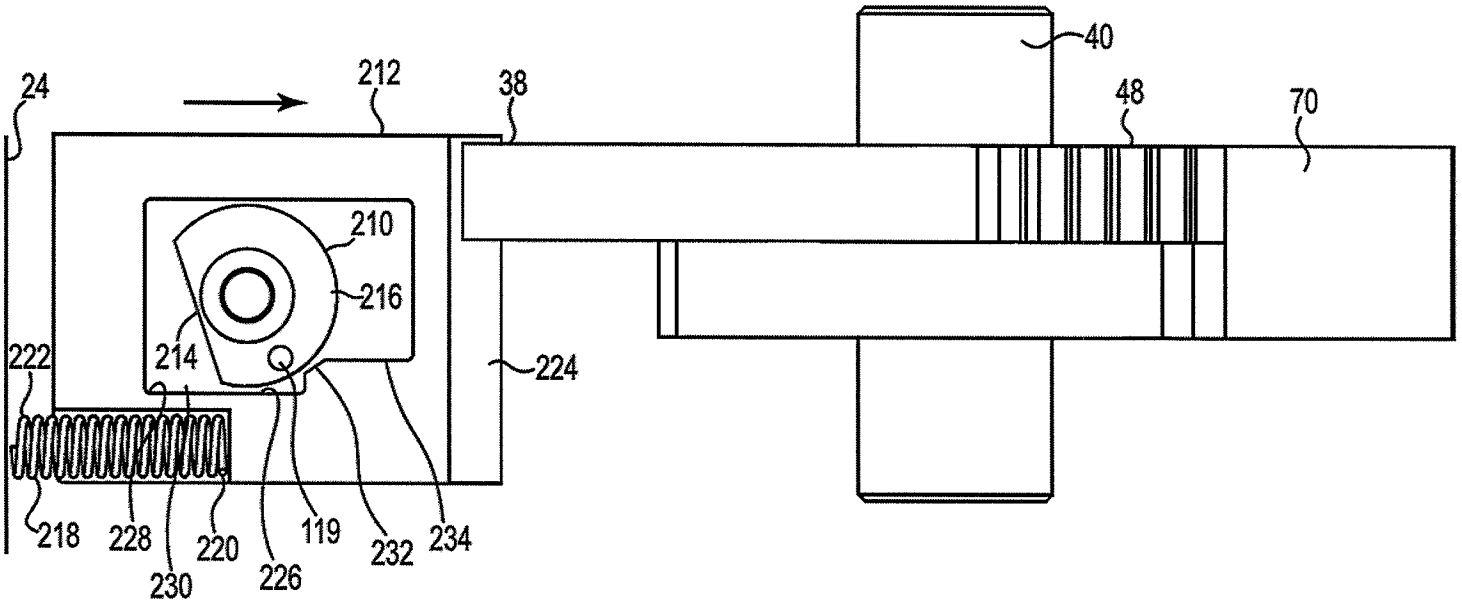
FIG. 12 is a cut away illustration showing the rectangular blocking member blocking the locking bolt from moving to the unlocked position with compression spring exerting a biasing force against the blocking member.
Figure 13:
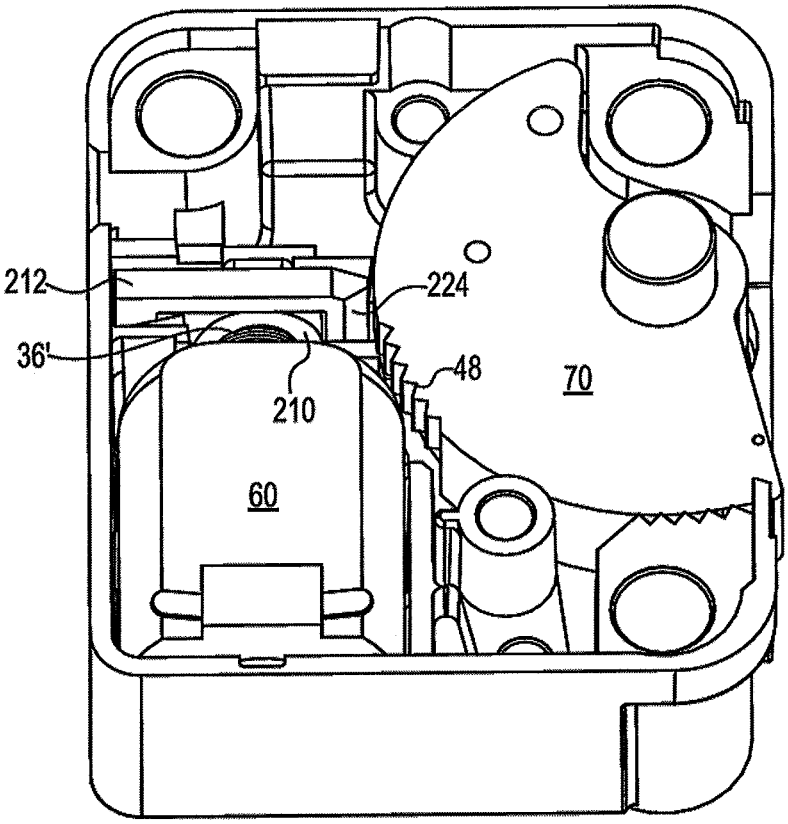
FIG. 13 is a top perspective view of the rectangular blocking member in the unblocking position allowing the locking bolt to move to the unlocked position.

The sliding blocking member 212 includes an inner portion 226 having a bottom surface 228 that includes a lower portion 230, a ramp section 232 and an elevated portion 234 that is higher than the lower portion 230. The D-shaped rotatable member 210 is operably coupled by shaft 114' and responsive to the rotary output of a rotary actuator 60. In the blocking position, as best seen in FIG. 12, the D-shaped rotatable member 210 is positioned in the lower portion 230 of blocking member 210 with a section of the rounded portion 216 abutting ramp 232. In this position, the ramp 232 and elevated portion 234 of the blocking member 219 cannot bypass the rounded portion 216 of the D-shaped rotatable member 210, i.e. if an unauthorized user applies force to the locking bolt. When actuated by rotary solenoid 60, the D-shaped member rotates so the flat portion 214 is substantially parallel to the bottom surface 228 of the sliding blocking member 212 and is now configured to allow the ramp 232 and elevated portion 234 to by-pass the D-shaped blocking member as will now be described. By "substantially parallel" we mean sufficiently parallel to the bottom surface 228 of the sliding blocking member 212 to allow the ramp 232 and elevated portion 234 to by-pass the D-shaped blocking member.

As previously noted, the D-shaped rotatable member 210 is configured to rotate between a first position corresponding to the locked position of the locking bolt 70 and a second position corresponding to the unlocked position of the locking bolt 70.

Figure 14:
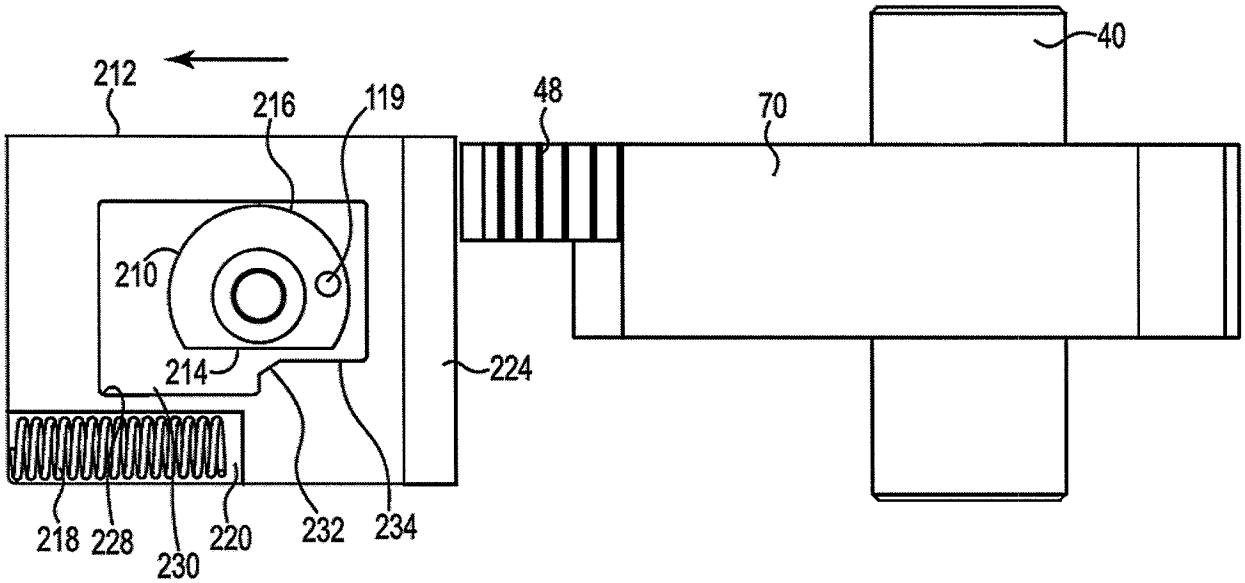
FIG. 14 is a cut away illustration showing the rectangular blocking member in the unblocking position allowing the locking bolt to move from the unlocked position to the unlocked position.

When a user enters the correct combination, the rotary actuator 60 causes the D-shaped rotatable member 210 to rotate to the unblocking position. In the unblocking position as best seen in FIG. 14, the D-shaped rotatable member 210 has rotated so that the flat portion 214 is substantially parallel to bottom surface 228 of the sliding blocking mechanism 212. Manual force applied by the user in turning the handle of the lock causes the tip portion 38 of the locking bolt to push against chamfered edge 224 causing the box-shaped in cross-section sliding blocking member 210 to move toward the unblocking position. The ramp 232 and elevated portion 234 can move past the flat portion 214 of D-shaped rotatable member 210 allowing the lock to be opened. When the locking bolt 70 returns to the locked position, spring 222 exerts a biasing force against the blocking member 210 causing it to return to the blocking position.

Although the present invention has been described with reference to certain aspects and embodiments, those of ordinary skill in the art will appreciate that changes may be made in form and detail without departing from the spirit and scope of the invention.

I claim:

1. A lock comprising:

a housing having an opening for receiving a locking bolt movable between a locked position and an unlocked position;

a rotary actuator positioned within the housing and energizable between a locked condition for maintaining the locking bolt in the locked position and an unlocked condition that allows the locking bolt to move to the unlocked position;

a sliding blocking mechanism received in said housing, said sliding blocking mechanism including a slider, a rotatable member having a camming surface engaged by a surface of the slider and a biasing member, the rotatable member rotatably responsive to an output of the rotary actuator, the rotatable member including a stop portion coupled to at least a surface of the rotatable member, said housing comprising a pocket to receive the stop portion so that when the rotatable member rotates, the stop portion will contact a respective surface of the pocket preventing said rotatable member from further rotation in either direction, said sliding blocking mechanism normally biased in a blocking position by the biasing member and configured to engage and block said locking bolt from being moved to the unlocked position, wherein upon actuation, the rotary actuator causes said rotatable member to rotate on the surface of the slider by a predetermined amount causing translational linear movement of said slider to an unblocking position allowing said locking bolt to move into said unlocked position.

2. The lock of claim 1 wherein said locking bolt is a rotary locking bolt.

3. The lock of claim 1 wherein said rotary actuator is a rotary electromagnetic device.

4. The lock of claim 3 wherein said rotary electromagnetic device is a rotary solenoid.

5. The lock of claim 1 further comprising a first spring coupled to said housing and said locking bolt for biasing said locking bolt in said locked condition.

6. The lock of claim 1 wherein the biasing member is a spring positioned between the rotary actuator and the rotatable member for biasing the rotatable member in a position corresponding to the blocking position of the sliding blocking mechanism.

7. The lock of claim 6 wherein said spring is a compression spring.

8. The lock of claim 1 wherein said slider is U-shaped in cross section and the surface of the slider includes a channel configured to engage the camming surface of the rotatable member.

9. The lock of claim 8 wherein said slider includes a first blocking arm and a second arm, said first blocking arm configured to block said locking bolt from being moved to the unlocked position.

10. A lock comprising:

a housing having a cavity with first and second opposing side walls and an opening for receiving a locking bolt, the locking bolt moveable between a locked position and an unlocked position;

a rotary actuator having a rotary output; and a sliding blocking mechanism including a substantially C-shaped in cross section rotatable member, a substantially U-shaped in cross section slider and a biasing member that biases the sliding blocking member in a blocking position, the rotatable member responsive to said rotary output and moveable between the blocking position for blocking said locking bolt in the locked position and an unblocking position for allowing said locking bolt to move into said unlocked position, said rotatable member having a camming surface and the substantially U-shaped in cross-section slider having a surface for engaging the camming surface and a blocking arm for blocking engagement with said rotary bolt, the rotatable member including a stop portion coupled to at least a surface of the rotatable member, said housing comprising a pocket to receive the stop portion so that when the rotatable member rotates, the stop portion will contact a respective surface of the pocket preventing said rotatable member from further rotation in either direction, wherein actuation of said rotary actuator causes said rotatable member to rotate on the surface of the substantially U-shaped in cross-section slider to cause linear movement of said substantially U-shaped in cross-section slider to the unblocking position allowing said locking bolt to move into said unlocked position.

11. A lock comprising:

a housing having a cavity with first and second opposing side walls and an opening for receiving a locking bolt, the locking bolt moveable between a locked position and an unlocked position;

a rotary actuator having a rotary output; and a sliding blocking mechanism including a rotatable member, a sliding blocking member and a biasing member that biases the sliding blocking member in a blocking position, the rotatable member responsive to said rotary output and moveable between a position corresponding to a blocking position of the sliding blocking member for blocking said locking bolt in the locked position and a position corresponding to an unblocking position of the sliding blocking member for allowing said locking bolt to move into said unlocked position, the rotatable member having a camming surface, the rotatable member including a stop portion coupled to at least a surface of the rotatable member, said housing comprising a pocket to receive the stop portion so that when the rotatable member rotates, the stop portion will contact a respective surface of the pocket preventing said rotatable member from further rotation in either direction, the sliding blocking member being substantially U-shaped in cross-section having a lower surface for engaging the camming surface of the rotatable member and a blocking arm for blocking engagement with said rotary bolt, wherein actuation of said rotary actuator causes said rotatable member to rotate on the lower surface of the U-shaped in cross-section sliding blocking member to cause said U-shaped in cross-section sliding blocking member to move linearly to an unblocking position in which the blocking arm disengages from the locking bolt allowing said locking bolt to move into said unlocked position.

12. A lock comprising:

a housing having a cavity with first and second opposing side walls and an opening for receiving a locking bolt, the locking bolt moveable between a locked position and an unlocked position;

a rotary actuator having a rotary output; and a sliding blocking mechanism including a substantially C-shaped in cross section cam having a camming surface on an outer periphery thereof and a substantially U-shaped in cross-section slider having an inner surface defining a channel for engaging said camming surface and a blocking arm for blocking engagement with said locking bolt, the C-shaped in cross section cam including a stop portion positioned on at least a surface thereof, said housing comprising a pocket to receive the stop portion so that when the rotatable member rotates, the stop portion contacts a respective surface of the pocket preventing said C-shaped cam from further rotation in either direction; and a biasing member for biasing the sliding blocking mechanism in a blocking position, wherein actuation of said rotary actuator causes said rotatable member to rotate in said channel thereby causing linear movement of said U-shaped slider to an unblocking position in which the blocking arm no longer blockingly engages the locking bolt allowing said locking bolt to move into said unlocked position.

13. A lock comprising:

a housing having a cavity with first and second opposing side walls and an opening for receiving a locking bolt, the locking bolt moveable between a locked position and an unlocked position;

a rotary actuator having a rotary output; and a sliding blocking mechanism including a closed, substantially rectangular-shaped in cross-section sliding blocking member having an inner portion and an outer perimeter, a biasing member that biases the sliding blocking mechanism in a blocking position and a D-shaped in cross section rotatable member positioned, within the inner portion of the sliding blocking member, the sliding blocking member having a bottom surface on an inner portion thereof that includes a lower portion, a ramp and an elevated portion, the rotatable member having a flat portion and a rounded portion, the rounded portion initially positioned in the lower portion of the sliding blocking member and corresponding to the blocking position for blocking said sliding blocking mechanism from moving, the rotatable member responsive to said rotary output and moveable between the blocking position for blocking said sliding blocking mechanism in the blocking position to prevent said locking bolt from moving into an unlocked position and an unblocking position in which the flat portion of the rotatable member is substantially parallel to the bottom portion thereby allowing the ramp and elevated portion of the sliding blocking member to by-pass the rotatable member to allow said locking bolt to move into said unlocked position, wherein the sliding blocking member further includes an outer perimeter including a first wall that acts as a stop member so that when the rotatable member rotates to allow the sliding blocking member to by-pass the rotatable member, the stop member contacts a surface of the housing side wall preventing the sliding blocking member from further movement.

14. The lock of claim 13 wherein the outer perimeter of the sliding blocking member including a second wall having, a chamfered edge configured to engage said locking bolt to maintain the locking bolt in the locked position.

15. The lock of claim 13 wherein the biasing member is a compression spring.

* * * * *